US007823392B2

(12) United States Patent
Locatelli et al.

(10) Patent No.: US 7,823,392 B2
(45) Date of Patent: Nov. 2, 2010

(54) TURBOMACHINE COMBUSTION CHAMBER ARRANGEMENT HAVING A COLLAR DEFLECTOR

(75) Inventors: David Locatelli, Gex (FR); Romain Nicolas Lunel, Brie Comte Robert (FR); Thomas Olivier Marie Noel, Vincennes (FR); Denis Jean Maurice Sandelis, Nangis (FR)

(73) Assignee: SNECMA, Paris (FR)

( * ) Notice: Subject to any disclaimer, the term of this patent is extended or adjusted under 35 U.S.C. 154(b) by 708 days.

(21) Appl. No.: 11/769,464

(22) Filed: Jun. 27, 2007

(65) Prior Publication Data

US 2008/0000447 A1 Jan. 3, 2008

(30) Foreign Application Priority Data

Jun. 29, 2006 (FR) ..... 06 52718

(51) Int. Cl.
*F02C 7/20* (2006.01)

(52) U.S. Cl. ..... 60/799; 60/752

(58) Field of Classification Search ..... 60/748, 60/752, 796, 798, 799, 800, 801
See application file for complete search history.

(56) References Cited

U.S. PATENT DOCUMENTS

| | | | | |
|---|---|---|---|---|
| 4,454,711 | A * | 6/1984 | Ben-Porat | 60/800 |
| 4,606,190 | A * | 8/1986 | Greene et al. | 60/39.23 |
| 4,999,996 | A * | 3/1991 | Duchene et al. | 60/798 |
| 5,222,358 | A * | 6/1993 | Chaput et al. | 60/796 |
| 5,894,732 | A * | 4/1999 | Kwan | 60/756 |
| 6,530,227 | B1 * | 3/2003 | Young et al. | 60/776 |
| 6,820,425 | B2 * | 11/2004 | David et al. | 60/743 |
| 6,871,501 | B2 * | 3/2005 | Bibler et al. | 60/772 |
| 7,140,189 | B2 * | 11/2006 | Markarian et al. | 60/796 |
| 7,478,534 | B2 * | 1/2009 | Guezengar et al. | 60/796 |
| 2007/0033950 | A1 * | 2/2007 | Bernier et al. | 60/796 |
| 2008/0000234 | A1 * | 1/2008 | Commaret et al. | 60/748 |

FOREIGN PATENT DOCUMENTS

| | | |
|---|---|---|
| EP | 0 833 107 A1 | 4/1998 |
| EP | 1 314 933 A1 | 5/2003 |
| FR | 2 825 778 A1 | 12/2002 |

OTHER PUBLICATIONS

U.S. Appl. No. 12/199,182, filed Aug. 27, 2008, Pieussergues, et al.

* cited by examiner

*Primary Examiner*—Michael Cuff
*Assistant Examiner*—Phutthiwat Wongwian
(74) *Attorney, Agent, or Firm*—Oblon, Spivak, McClelland, Maier & Neustadt, L.L.P.

(57) ABSTRACT

An arrangement for a turbomachine combustion chamber is disclosed. The arrangement includes a chamber end wall pierced by at least one substantially circular opening, a deflector mounted from the downstream side of the chamber end wall in the opening by an annulus, an injector system associated with the opening and including an annular bowl that is flared downstream, passing through the opening, and a pinch ring that cooperates with the annulus to allow the injector system to shift off-center relative to the chamber end wall. The deflector includes an annular collar extending radially inwards. The bowl of the injector system includes at its downstream end an outwardly-open annular groove radially in alignment with the collar of the deflector in such a manner as to enable it to retract into said groove when the injector system shifts off-center relative to the chamber end wall.

11 Claims, 2 Drawing Sheets

TURBOMACHINE COMBUSTION CHAMBER ARRANGEMENT HAVING A COLLAR DEFLECTOR

BACKGROUND OF THE INVENTION

The present invention relates to the general field of turbomachine combustion chambers. It relates more particularly to an arrangement for a combustion chamber of the type comprising a chamber end wall pierced by at least one circular opening, an injector system associated with the opening, and a deflector mounted on the downstream side of the chamber end wall in the opening.

In general, an annular combustion chamber of a turbomachine comprises two longitudinal annular walls (an inner wall and an outer wall) that are interconnected at their respective upstream ends by a transverse wall that is likewise annular and that forms a chamber end wall. The chamber end wall includes a plurality of circular openings that are regularly spaced apart and in which there are mounted injector systems for injecting an air fuel mixture that is to burn inside the combustion chamber.

The fuel is delivered to the injector system via injectors secured to the casing of the turbomachine and having heads centered on the injector system. Air is introduced into each injector system by means of one or more air swirlers that open out downstream from the fuel injector head. In addition, a downwardly-flared bowl is mounted in each opening so as to ensure that the air/fuel mixture is well distributed in the primary zone of the combustion area. Finally, a deflector mounted in each opening in the chamber end wall on the downstream side thereof serves to provide the chamber end wall with thermal protection against the high temperatures of the gas that results from combustion of the air/fuel mixture in the combustion chamber.

Thermal expansion differences exist between the turbomachine casing to which the fuel injectors are connected and the walls of the combustion chamber. In order to accommodate these expansion differences, it is therefore necessary to provide a certain amount of freedom of movement between the combustion chamber and the injector systems. For this purpose, provision can be made to center the fuel injector heads on a sliding cross-member capable of moving radially relative to the injector system (reference can be made for example to document EP 0 833 107). Alternatively, in certain circumstances, lack of concentricity between the injector and the associated injection system is unacceptable, so expansion differences must be accommodated by sliding the injector system relative to the chamber end wall. The invention relates to an arrangement of that latter type.

Such an arrangement must comply with another constraint. In the event of a break in one of the brazed or welded connections connecting together the component parts of the arrangement, it is essential to ensure that none of these parts becomes detached and falls into the combustion chamber where there is a risk it would damage the high pressure turbine mounted at the outlet from the chamber. In order to counter such an event, it is known to give the component parts of the arrangement a diameter that is greater than the diameter of the opening in the chamber end wall and to mount them from the upstream side of the chamber end wall.

Furthermore, it is common practice to provide the bowl of the injector system with a collar that projects inside the chamber end wall and that extends parallel thereto. The main function of such a collar is to protect the injector system against combustion flames in the event of the injector system being off-centered relative to the chamber end wall. Unfortunately, with an arrangement in which the component parts are mounted from the upstream side of the chamber end wall, the bowl collar that needs to pass through the opening in the chamber end wall necessarily presents a diameter that is smaller than the diameter of the opening. Thus, in the event of the injector system being significantly off-centered relative to the chamber end wall, the bowl collar no longer performs its function of providing thermal protection against combustion flames.

OBJECT AND SUMMARY OF THE INVENTION

A main object of the present invention is thus to mitigate such drawbacks by proposing a turbomachine combustion chamber arrangement that enables the injector system to be protected effectively against the combustion flames regardless of the extent to which the injector system shifts off-center relative to the chamber end wall, while ensuring that none of its component parts falls into the inside of the combustion chamber in the event of a brazed or welded connection breaking.

These objects are achieved by an arrangement for a turbomachine combustion chamber, comprising a chamber end wall pierced by at least one substantially circular opening, a deflector mounted from the downstream side of the chamber end wall in the opening by means of an annulus, an injector system associated with the opening and including an annular bowl that is flared downstream, passing through said opening, and means enabling the injector system to shift off-center relative to the chamber end wall, and in which, in accordance with the invention, the deflector includes an annular collar extending radially inwards, and the bowl of the injector system includes at its downstream end an outwardly-open annular groove radially in alignment with the collar of the deflector in such a manner as to enable it to retract into said groove in the event of the injector system shifting off-center relative to the chamber end wall.

The presence of the deflector collar serves to protect the bowl of the injector system effectively against the combustion flames regardless of the extent to which the injector system shifts off-center relative to the chamber end wall. Furthermore, with such an arrangement, all of the component parts of the injector system can be of a diameter greater than the diameter of the opening in the chamber end wall and they can be mounted from the upstream side, thus guaranteeing that none of these parts can pass through the opening and fall into the inside of the combustion chamber, in particular in the event of a brazed or welded connection failing.

In an advantageous disposition of the invention, the annular groove of the bowl is formed by two side walls that are axially spaced apart and interconnected by an annular bottom wall, the distance between said side walls of the groove being greater than the thickness of the collar of the deflector so as to allow ventilation air to flow regardless of the off-centering of the injector system relative to the chamber end wall.

In another advantageous disposition of the invention, the means enabling the injector system to shift off-center relative to the chamber end wall comprise a pinch ring mounted from the upstream side of the chamber end wall and fastened against the annulus whereby together they define an annular groove that is open towards the axis of the opening in the chamber end wall, the bowl of the injector system further including an annular end plate suitable for sliding radially in the groove formed by the pinch ring and the annulus.

Preferably, the end plate of the bowl is extended downstream by a substantially cylindrical portion that is connected to the groove via an annular shoulder. Under such circumstances, the shoulder of the bowl is pierced by a plurality of ventilation holes open to the upstream side of the chamber end wall and leading to the downstream side thereof in register with the collar of the deflector.

According to yet another advantageous disposition of the invention, the radial height of the collar of the deflector is not less than that of the end plate of the bowl so as to protect the injector system regardless of the extent to which the injector system is off-center relative to the chamber end wall.

According to yet another advantageous disposition of the invention, the injector system further includes at least one air swirler fastened to the upstream end of the bowl, and a centering ring fastened to the upstream end of the air swirler and surrounding a fuel injector.

The invention also provides a combustion chamber and a turbomachine including an arrangement as defined above.

BRIEF DESCRIPTION OF THE DRAWINGS

Other characteristics and advantages of the present invention appear from the following description made with reference to the accompanying drawings that show an embodiment without any limiting character.

In the figures.

DETAILED DESCRIPTION OF AN EMBODIMENT

Figure 1:
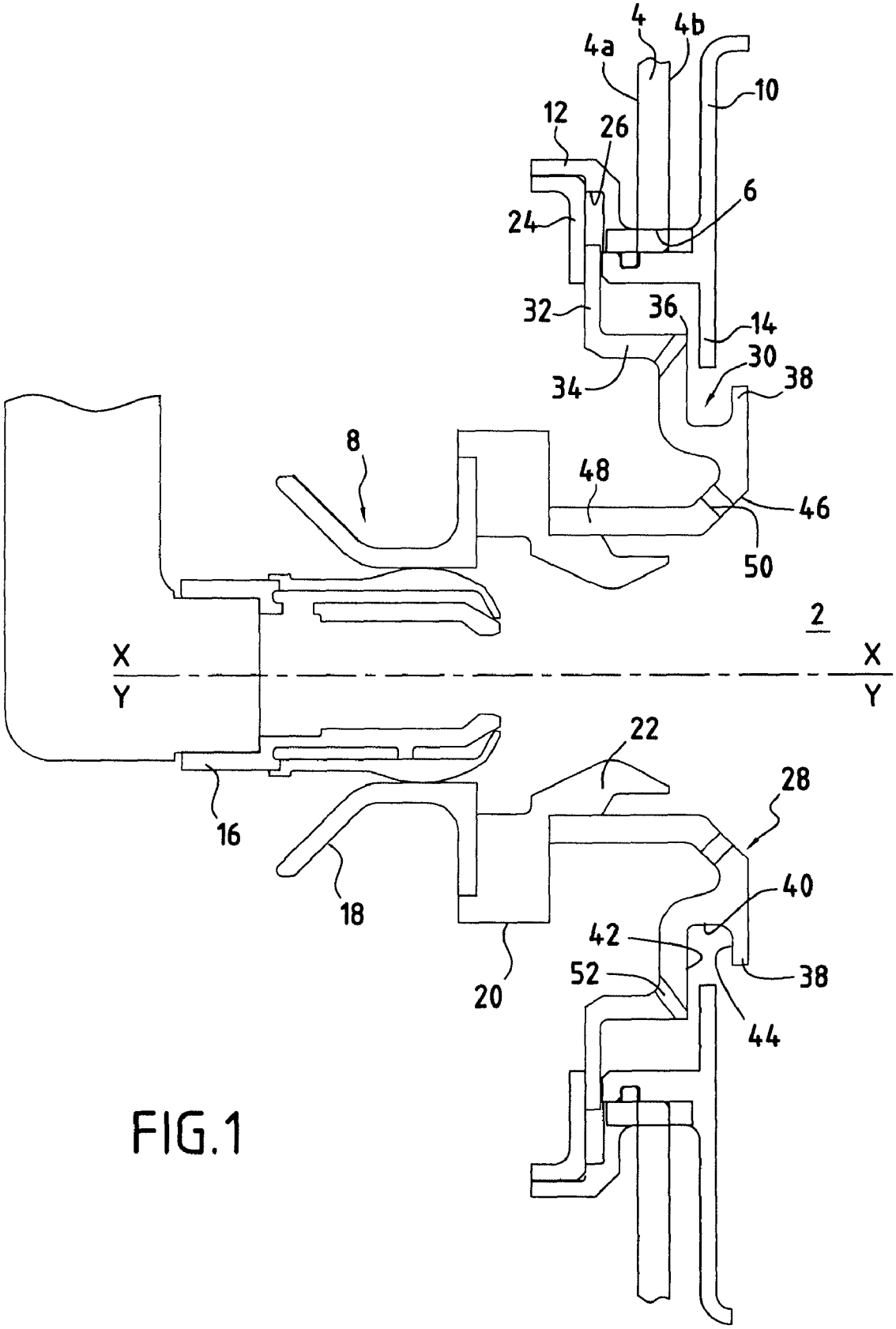
FIG. 1 is a fragmentary section view of a combustion chamber including an arrangement of the invention.
Figure 2:
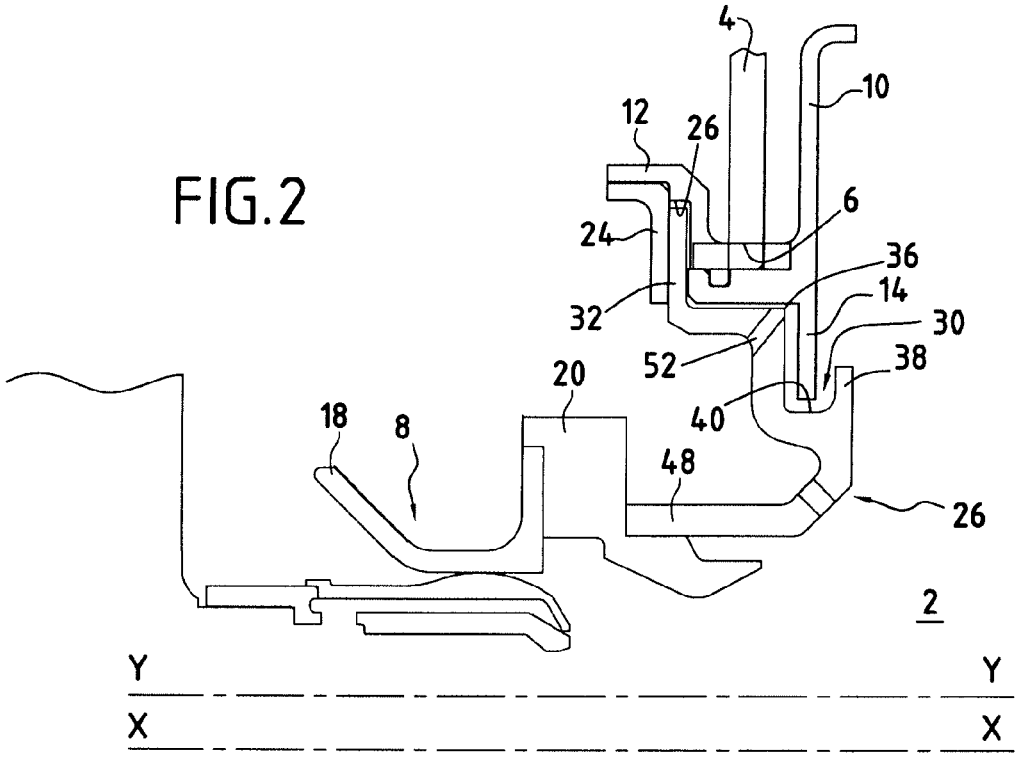
FIGS. 2 and 3 are views corresponding to FIG. 1 in which the injector system is off-centered relative to the chamber end wall.
Figure 3:
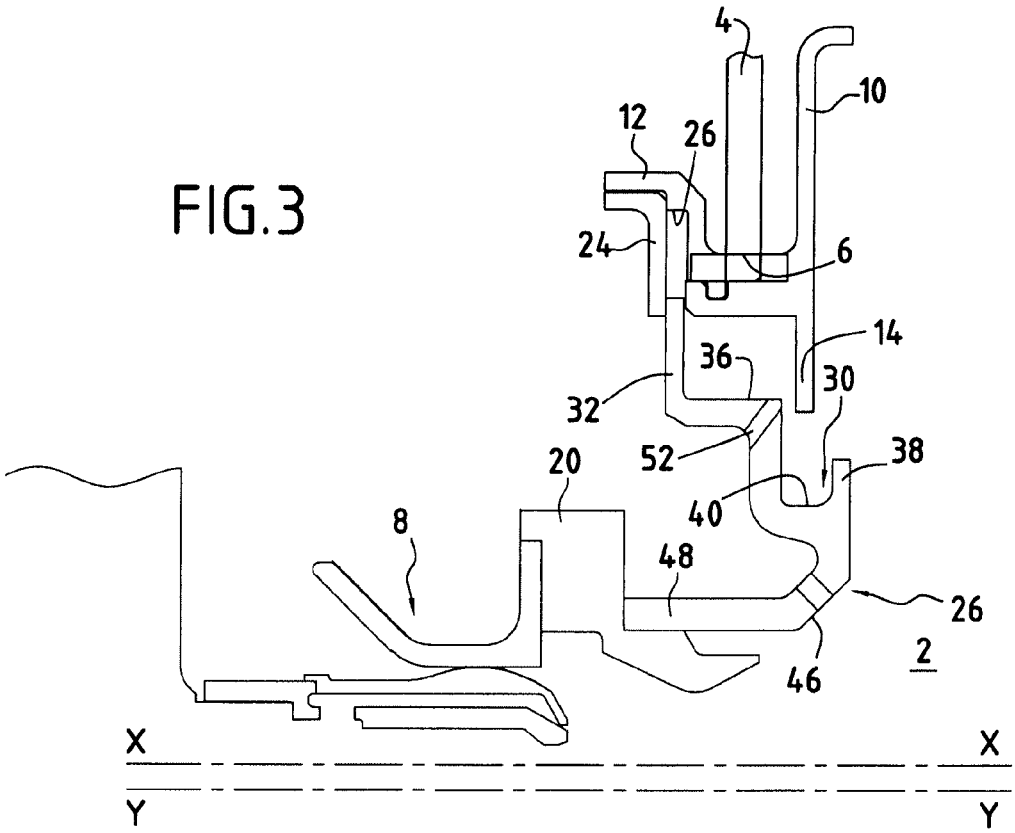

FIGS. 1 to 3 show a fragmentary section view of a turbomachine combustion chamber 2 fitted with an arrangement of the invention.

In a manner that is itself well known, such a combustion chamber 2 is made up of an inner longitudinal annular wall and an outer longitudinal wall (these walls not being shown in FIG. 1), which walls are interconnected at their respective upstream ends by a transverse annular wall forming the end wall of the chamber.

The chamber end wall 4 presents an upstream side 4*a* and a downstream side 4*b*, the downstream side facing towards the inside of the combustion chamber 2. The chamber end wall is pierced by a plurality of openings 6 that are regularly spaced apart, each being substantially circular in shape about an axis X-X. An injector system 8 for injecting an air/fuel mixture is associated with each of these openings 6.

A deflector 10 protecting the chamber end wall 4 from combustion flames is also mounted in each of the openings 6 on the downstream side 4*b* of the chamber end wall via an annulus 12 projecting from the upstream side.

In accordance with the invention, the deflector 10 presents an annular collar 14 that extends radially inwards (i.e. towards the axis X-X of the opening 6 in the chamber end wall). As explained below, the collar 14 of the deflector serves to protect the injector system against combustion flames.

Each injector system 8 possesses an axis of symmetry Y-Y and comprises in particular a fuel injector secured to the casing of the turbomachine (not shown in the figures). The head 16 of the injector disposed on the upstream side 4*a* of the chamber end wall 4 and it is centered on the axis Y-Y of the injector system via a centering ring 18 that surrounds it.

One or more air swirlers 20, possibly including venturies 22, are fastened to the downstream end of the centering ring 18 of the injector system. This or these air swirlers 20 enable air to penetrate into the injector system along a direction that is substantially radial and to mix with the fuel delivered by the head 16 of the fuel injector. The air/fuel mixture then penetrates into the combustion chamber 2 where it is ignited.

Each injector system 8 also has a "pinch" ring 24 that is mounted on the upstream side 4*a* of the chamber end wall 4 and that is fastened against the annulus 12 for holding the deflector 10. The pinch ring 24 is centered on the axis X-X of the opening 6 in the chamber end wall and co-operates with the annulus 12 to define an annular groove 26 that is open towards the axis X-X.

Each injector system 8 also has a bowl 28 fastened against the downstream end of the air swirler 20 and serving to provide good distribution of the air/fuel mixture in the primary zone of the combustion area.

The bowl 28 is mounted in the corresponding opening 6 of the chamber end wall 4 and passes therethrough. It is generally in the form of a ring centered on the axis Y-Y of the injector system and it terminates at its downstream end with a channel section annular groove 30 that is outwardly open (i.e. open away from the axis X-X of the opening in the chamber end wall), and that is in radial alignment with the collar 14 of the deflector 10.

At its upstream end, the bowl 28 has an annular end plate 32 mounted on the upstream side 4*a* of the chamber end wall 4 and suitable for sliding radially inside the groove 26 formed between the pinch ring 24 and the annulus 12 for holding the deflector 10, thus enabling the injector system 8 to shift off-center relative to the chamber end wall 4.

Thus, the head 16 of the fuel injector and the injector system assembly 8 are mounted to slide relative to the chamber end wall so as to accommodate thermal expansion differences between the casing and the combustion chamber. With this type of arrangement, the head 16 of the fuel injector thus remains continuously centered relative to the injector system 8.

The end plate 32 of the bowl is extended downstream by a substantially cylindrical portion 34 of diameter that is smaller than the diameter of the opening 6, and it is connected to the groove 30 by an annular shoulder 36 on the upstream side thereof. The groove 30 is disposed behind an annular flange 38 that projects radially outwards and that is of a diameter that is smaller than the diameter of the shoulder 36.

The groove 30 of the bowl is formed by two annular side walls 42, 44 that are axially spaced apart and that are interconnected at their inside ends by an annular bottom wall 40, one of the side walls 42 being connected at its outer end to the shoulder 36, and the other side wall 44 being connected at its outer end to the flange 38.

The flange 38 is the portion of the bowl that is situated furthest downstream. The flange is extended upstream by a portion 46 that flares downstream, this flared portion 46 itself being extended upstream by a cylindrical portion 48 that is concentric with the cylindrical portion 34 of the bowl (and of smaller diameter) and is connected to the air swirler 20. The flared portion 46 of the bowl is pierced by a plurality of air introduction holes 50.

The shoulder 36 of the bowl is also pierced by a plurality of ventilation holes 52 open on the upstream side of the chamber end wall 4 and leading to its downstream side in register with the collar 14 of the deflector 10. The air flowing through the ventilation holes 52 cools the collar 14 of the deflector from the upstream side and then flows into the groove 30 of the bowl so as to create a film of air that then flows radially along the downstream side of the deflector 10 in order to cool it.

The operation of such an arrangement is described below, in particular in the event of the injector system 8 becoming off-center relative to the chamber end wall 4.

In FIG. 1, there is no off-centering between the injector system 8 and the chamber end wall 4 (i.e. the axis X-X of the opening 6 in the chamber end wall coincide with the axis of symmetry Y-Y of the injector system). In this situation, the collar 14 of the deflector 10 that extends radially inwards does indeed provide effective thermal protection for the injector system (and in particular the end plate 32) against combustion flames.

FIG. 2 shows one of the two possible configurations of maximum off-centering between the injector system and the chamber end wall (the axis of symmetry Y-Y of the injector system is offset radially outwards from the axis X-X of the opening in the chamber end wall). In this situation, the radial distance between the shoulder 36 and the bottom wall 40 of the bowl groove 30 is preferably not less than the radial height of the collar 14 of the deflector 10 so that the collar can be retracted entirely within the groove of the bowl. The end plate 32 of the injector system is then completely retracted in the groove 26 and is thus well protected against combustion flames.

FIG. 3 shows the other possible configuration of the injector system being maximally off-center relative to the chamber end wall (the axis of symmetry Y-Y of the injector system is offset radially inwards from the axis X-X of the opening in the chamber end wall). In this configuration, the collar 14 of the deflector 10 continues to perform its function of thermally protecting the injector system against the combustion flames by completely covering the end plate 32. This is due to the fact that the radial height of the collar 14 of the deflector is preferably not less than that of the end plate 32 of the bowl.

According to an advantageous characteristic of the invention, the distance between the side walls 42, 44 of the bowl groove 30 is greater than the thickness of the collar 14 of the deflector 10 so as to allow ventilation air passing through the holes 52 pierced in the shoulder 36 to flow regardless of the off-centering of the injector system relative to the chamber end wall. Thus, in the extreme off-centered configuration of FIG. 2, the ventilation air flowing through the holes 52 continues to flow inside the groove 30 by going round the collar 14 of the deflector.

The arrangement of the invention is mounted as follows. The deflector-holding annulus 12, the bowl 28, the pinch ring 24, the air swirler 20, and the centering ring 18 are mounted from the upstream side (i.e. from the side 4*a* of the chamber end wall 4), and they are fastened to one another (e.g. by brazing or by welding). The deflector 10 is mounted in the opening 6 in the chamber end wall 4 from the downstream side (i.e. from the side 4*b* of the chamber end wall) and is then fastened to the annulus 12.

It can thus be understood that even in the event of the brazing or welding making the connection between the various component parts of the injector system, none of the parts can fall into the combustion chamber 2.

It can also be understood that given that the deflector 10 is mounted from the downstream side, the collar 14 thereof can present a diameter smaller than the diameter of the opening 6 in the chamber end wall 4, which is selected as a function of the maximum possible off-centering differences of the injector system relative to the chamber end wall so as to ensure continuous thermal protection for the injector system against the combustion flames.

What is claimed is:

1. An arrangement for a turbomachine combustion chamber, comprising:

a chamber end wall pierced by at least one substantially circular opening;

a deflector mounted from a downstream side of the chamber end wall in the opening;

an annulus which mounts the deflector in the opening in the chamber end wall;

an injector system associated with the opening and including an annular bowl that is flared downstream which passes through said opening; and a pinch ring mounted on an upstream side of the chamber end wall which is fastened to the annulus, wherein the pinch ring cooperates with the annulus to define an inwardly-open annular groove which allows the injector system to shift off-center relative to the chamber end wall, wherein the deflector includes an annular collar extending radially inwards, and wherein the bowl of the injector system includes at its downstream end an outwardly-open annular groove which is radially aligned with the collar of the deflector such that the collar of the deflector retracts into said outwardly-open annular groove of the bowl when the injector system shifts off-center relative to the chamber end wall.

2. The arrangement according to claim 1, wherein the outwardly-open annular groove of the bowl is formed by two side walls that are axially spaced apart and interconnected by an annular bottom wall, the distance between said side walls of the groove being greater than a thickness of the collar of the deflector so as to allow ventilation air to flow regardless of the off-centering of the injector system relative to the chamber end wall.

3. The arrangement according to claim 1, wherein the bowl of the injector system further includes an annular end plate which slides radially in the inwardly-open annular groove formed by the pinch ring and the annulus.

4. The arrangement according to claim 3, wherein the end plate of the bowl is extended downstream by a substantially cylindrical portion that is connected to the outwardly-open annular groove by an annular shoulder.

5. The arrangement according to claim 4, wherein the shoulder of the bowl is pierced by a plurality of ventilation holes open to the upstream side of the chamber end wall and leading to the downstream side thereof in register with the collar of the deflector.

6. The arrangement according to claim 3, wherein a radial height of the collar of the deflector is not less than a radial height of the end plate of the bowl so as to protect the injector system regardless of the extent to which the injector system is off-center relative to the chamber end wall.

7. The arrangement according to claim 1, wherein the injector system further includes at least one air swirler fastened to the upstream end of the bowl, and a centering ring fastened to the upstream end of the air swirler and surrounding a fuel injector.

8. A turbomachine combustion chamber including an arrangement according to claim 1.

9. A turbomachine including an arrangement according to claim 1.

10. The arrangement according to claim 1, wherein the inwardly-open annular groove is defined by a side wall of the pinch ring and a shoulder and a side wall of the annulus.

11. The arrangement according to claim 1, wherein the pinch ring is fastened to the annulus by brazing or welding.

* * * * *